US007631453B2

(12) United States Patent
Longueira

(10) Patent No.: US 7,631,453 B2
(45) Date of Patent: Dec. 15, 2009

(54) INTERCHANGEABLE CALIBER SEMI-AUTOMATIC RIFLE

(76) Inventor: Dino C. Longueira, 32 Green Valley Rd., Staten Island, NY (US) 10312

( * ) Notice: Subject to any disclaimer, the term of this patent is extended or adjusted under 35 U.S.C. 154(b) by 460 days.

(21) Appl. No.: 11/042,717

(22) Filed: Jan. 24, 2005

(65) Prior Publication Data

US 2006/0162217 A1 Jul. 27, 2006

(51) Int. Cl.
*F41A 7/00* (2006.01)

(52) U.S. Cl. ..... 42/16; 42/75.02; 42/75.01; 42/76.01; 42/77

(58) Field of Classification Search ..... 42/16, 42/77, 76.01, 75.02, 75.01, 2; 89/29
See application file for complete search history.

(56) References Cited

U.S. PATENT DOCUMENTS 2,296,729 A * 9/1942 Mossberg ..... 42/50
2,898,693 A * 8/1959 Ruger ..... 42/77
3,656,250 A * 4/1972 Brown ..... 42/76.01
3,708,841 A * 1/1973 Quinney ..... 42/76.1
3,731,418 A * 5/1973 Birkenhagen et al. ..... 42/75.02
3,776,095 A * 12/1973 Atchisson ..... 89/128
3,791,060 A * 2/1974 Weaver ..... 42/16
4,220,071 A * 9/1980 Seiderman ..... 89/128
4,515,064 A * 5/1985 Hohrein ..... 89/128
4,531,446 A * 7/1985 VanVoorhees ..... 89/29
4,542,606 A * 9/1985 Hoenig ..... 42/75.02
4,580,484 A * 4/1986 Moore ..... 89/128
4,608,909 A 9/1986 Peters ..... 89/196
4,907,362 A * 3/1990 Hobbie ..... 42/77
5,046,275 A * 9/1991 Brown ..... 42/25
5,228,887 A * 7/1993 Mayer ..... 42/75.02
5,325,617 A * 7/1994 Vojta et al. ..... 42/75.03
5,410,834 A 5/1995 Benton et al. ..... 42/75.02
5,454,182 A * 10/1995 Lewis et al. ..... 42/51
5,614,691 A 3/1997 Taylor ..... 89/128
5,987,797 A * 11/1999 Dustin ..... 42/75.02
6,019,024 A * 2/2000 Robinson et al. ..... 89/1.42

(Continued)

OTHER PUBLICATIONS

Tulsa Gun Room, Blaser Firearms, www.tulsagunroom.com/fire-arm/blaser, downloaded Dec. 23, 2004.

*Primary Examiner*—Michelle Clement
(74) *Attorney, Agent, or Firm*—Ostrager Chong Flaherty & Broitman P.C.

(57) ABSTRACT

A semi-automatic rifle kit comprises a receiver; first and second bolt assemblies that can be interchangeably inserted inside the receiver when no barrel is coupled to the receiver; and first and second barrels that can be interchangeably coupled to the receiver when no bolt assembly is inserted inside the receiver. The first bolt assembly can be inserted inside the receiver when the first barrel is coupled to the receiver, but not when the second barrel is coupled to the receiver. The second bolt assembly can be inserted inside the receiver when the second barrel is coupled to the receiver, but not when the first barrel is coupled to the receiver. The first bolt assembly and the first barrel are designed for use with a first type of cartridge, but not a second type of cartridge. The second bolt assembly and the second barrel being are designed for use with the second type of cartridge, but not the first type of cartridge.

8 Claims, 6 Drawing Sheets

U.S. PATENT DOCUMENTS 6,061,944 A * 5/2000 Schroeder ..... 42/16
6,293,040 B1 * 9/2001 Luth ..... 42/75.01
6,571,501 B1 * 6/2003 Jennings ..... 42/70.02
6,609,323 B1 8/2003 Donnelly ..... 42/75.02
6,732,465 B2 * 5/2004 Strayer ..... 42/69.03
7,121,035 B2 * 10/2006 Greer ..... 42/77
2006/0026883 A1 * 2/2006 Hochstrate et al. ..... 42/75.01
2006/0037464 A1 * 2/2006 Moore ..... 89/125

* cited by examiner

INTERCHANGEABLE CALIBER SEMI-AUTOMATIC RIFLE

BACKGROUND OF THE INVENTION

This invention relates in general to firearms, and in particular to rimfire rifles.

A rimfire rifle is so called because it fires rimfire cartridges. A rimfire cartridge has priming compound disposed around the inside rim of the cartridge casing base, the priming compound igniting the powder charge and causing discharge when the bottom of the cartridge is struck.

The popular rimfire calibers are known as follows: .22 Winchester Magnum Rimfire (.22 wmrf); .17 Hornady Rimfire Magnum (.17 hrm); .22 Long Rifle (.22 lr); and .17 Hornady Mach 2 (.17 hm2). The lengths and diameters of the cartridge casings for the .22 wmrf and .17 hrm calibers (referred to herein as "magnum calibers") are the same. Consequently, rifles that shoot these calibers can utilize the same bolt and the same magazine, but they require different barrels. The .22 lr and .17 hm2 calibers (referred to herein as "small calibers") are based on the same shorter cartridge casing. Rifles that shoot these calibers can utilize the same bolt and the same magazine, but the bolt and magazine for the 22 lr and .17 hm2 calibers is different than the bolt and magazine for the 22 wmrf and .17 hrm calibers. The .22 wmrf and .22 lr calibers have in common the diameter of the bullet, which is approximately 0.220 (inch). The cartridge casings for the 22 wmrf and .22 lr calibers being different in length and diameter, their respective barrels are different because of the differences in the chamber dimensions. [The chamber is the portion at the rear of the barrel (hereinafter "the barrel shank") which is bored or reamed open to accept the cartridge.] The .17 hrm and .17 m2 calibers also have in common the diameter of the bullet, which is approximately 0.170, but they also require different barrels due to differences in chamber dimensions.

Known semi-automatic rimfire rifles are not designed to shoot different rimfire calibers. Although certain rifle designs can be converted to shoot other calibers, this requires gunsmithing work as they are not designed to do this. Previously a shooter who wished to shoot different caliber rimfire ammunition would have to purchase a different rifle for each caliber.

There is a need for a semi-automatic rifle design that would allow the shooter to purchase only one rifle that he/she may reconfigure to shoot cartridges (e.g., rimfire cartridges) of the caliber of his/her choice. This would result in a tremendous financial saving to the shooter and allow shooters a degree of flexibility previously unavailable.

BRIEF DESCRIPTION OF THE INVENTION

The present invention is directed to providing a semi-automatic rifle having interchangeable components that can be assembled to the same receiver in different configurations.

One aspect of the invention is a method of reconfiguring a semi-automatic rifle from a first configuration to a second configuration, wherein the semi-automatic rifle in the first configuration can shoot a first type of cartridge, but not a second type of cartridge, and in the second configuration can shoot the second type of cartridge, but not the first type of cartridge, the method comprising the following steps: (a) uncoupling a first barrel from a receiver of the semi-automatic rifle, the first barrel having a chamber designed to hold a cartridge of the first type; (b) after step (a) has been performed, coupling a second barrel to the receiver, the second barrel having a chamber designed to hold a cartridge of the second type; (c) removing a first bolt assembly from inside the receiver, the first bolt assembly being designed to interact with a cartridge of the first type; and (d) after step (c) has been performed, inserting a second bolt assembly inside the receiver, the second bolt assembly being designed to interact with a cartridge of the second type.

Another aspect of the invention is a semi-automatic rifle comprising a receiver, a barrel coupled to the receiver, a bolt assembly removably housed inside the receiver, a magazine inserted into the receiver, an ejector pin fixedly supported inside the receiver, and a hammer pivotably mounted to the receiver, wherein the bolt assembly comprises a bolt having a channel that overrides the ejector pin when the bolt assembly is removed from the receiver.

A further aspect of the invention is a semi-automatic rifle kit comprising: a receiver; first and second bolt assemblies that can be interchangeably inserted inside the receiver when no barrel is coupled to the receiver; and first and second barrels that can be interchangeably coupled to the receiver when no bolt assembly is inserted inside the receiver, the first bolt assembly and the first barrel being designed for use with a first type of cartridge, but not a second type of cartridge. and the second bolt assembly and the second barrel being designed for use with the second type of cartridge, but not the first type of cartridge.

Other aspects of the invention are disclosed and claimed below.

BRIEF DESCRIPTION OF THE DRAWINGS

Reference will now be made to the drawings in which similar elements in different drawings bear the same reference numerals.

DETAILED DESCRIPTION OF THE INVENTION

Figure 1:
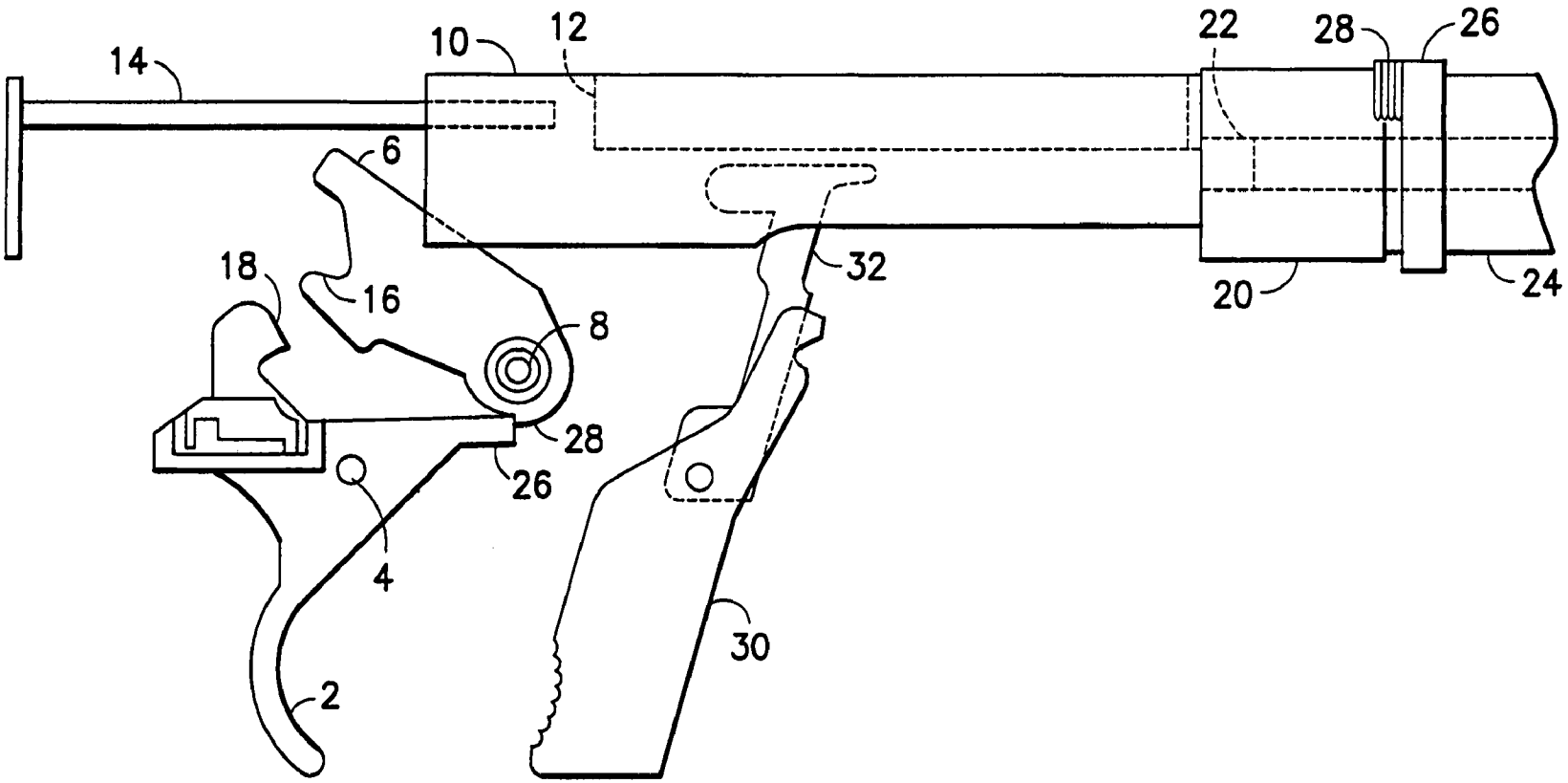
FIG. 1 is a drawing showing a side view of various components (in correct positional relationship) of a semi-automatic rimfire rifle configured to shoot magnum-caliber ammunition. The receiver and a magnum-caliber magazine are not shown.

The preferred embodiment of the present invention is directed to providing a semi-automatic rimfire rifle having interchangeable components that can be assembled to the same receiver in different configurations. However, the broad concept of the invention is applicable to rifles that shoot centerfire ammunition.

The receiver is the frame of a firearm. This component bears the serial number and for legal purposes is considered to be the actual firearm. All other components are installed in (e.g., the trigger and bolt assemblies and the magazine) or coupled to (e.g., the barrel) the receiver. The present invention is based on the concept of interchanging barrels, bolt assemblies and magazines with the same receiver to configure a rifle to shoot different calibers of ammunition.

In accordance with the embodiment to be disclosed hereinafter, a kit comprising various components provides a rimfire rifle system in which the receiver is capable of firing all popular rimfire calibers, namely, 22 Winchester Magnum Rimfire (.22 wmrf); .17 Hornady Rimfire Magnum (.17 hrm); .22 Long Rifle (.22 lr); and .17 Hornady Mach 2 (.17 hm2) (previously described in the Background of the Invention section). In the past a shooter might purchase different rifles specific to each caliber. The inventor is aware of existing rifles that can be converted from .22 wmrf to .17 hrm), or from .22 lr to .17 hm2). But to do so requires gunsmithing work and switching at will is not possible. The embodiment disclosed herein has been designed to be readily converted to any popular rimfire caliber.

The first part of this concept is to have a receiver and a magazine that are sized to handle the largest of the rimfire calibers. By merely changing certain components (in all cases, the barrel, and in some cases, also the bolt assembly and the magazine) that were designed to be readily removed and reinstalled, the user can reconfigure the rifle to shoot different calibers.

In order to construct a rifle that would interchangeably shoot different calibers, the receiver, bolt and magazine were designed to be large enough for the magnum calibers. In accordance with one embodiment of the present invention, when switching from .22 wmrf to .17 hrm caliber, the bolt and magazine remain the same; one need only change the barrel. Changing the barrel is facilitated by unscrewing the barrel nut, which fastens the barrel to the receiver. Once this is done, the barrel may easily be removed. By switching from a .22 caliber barrel to a .17 caliber barrel, one can reconfigure the rifle to shoot .17 hrm cartridges instead of .22 wmrf cartridges. In order to change from the magnum calibers to the small calibers, one must also change the bolt and magazine along with the barrel. The magnum calibers use a casing that is approximately 0.273 inch longer than the small calibers. This difference in length combined with the difference in casing diameter requires a different bolt from magnum calibers to small calibers. When one wishes to change from magnum calibers to small calibers, one must unscrew the barrel nut, thus releasing the barrel from the receiver. The barrel may then be removed. The next step is to remove the magnum caliber bolt. The bolt assembly is easily removed by pulling out the cocking handle and then removing the entire bolt assembly through the front of the receiver.

In other known rifle designs, other components (such as the ejector pin and hammer) must be removed prior to removal of the bolt assembly. In accordance with the embodiment disclosed herein, the bolt assembly is designed to override the ejector pin and hammer to facilitate rapid removal. Once the magnum-caliber bolt assembly is removed, the user must now install the small-caliber bolt assembly. The small-caliber bolt assembly is inserted through the front of the receiver and pressed into place. Then the cocking handle is replaced. The user can now install the appropriate small-caliber barrel. At this point the rifle has been reconfigured from magnum calibers to small calibers. The last step in the procedure would be to insert a small-caliber magazine into the receiver.

In accordance with the semi-automatic rifle kit disclosed herein, the magnum-caliber bolt assembly is longer than the bolt assembly for small calibers. The receiver is designed around the larger magnum calibers. The bolt assembly and barrel are proportionately sized for this. The bolt assembly for the small calibers is shorter by approximately 0.273 inch. The small-caliber bolt assembly is designed so that, when it is installed in the receiver, the critical portion with the firing pin aligns within the receiver and mimics the bolt assembly of the magnum calibers. More precisely, the rear end of the firing pin impacted by the hammer (the hammer assembly is unchanged for all configurations) must be located in substantially the same place for both magnum- and small-caliber bolt assemblies. The difference in length is in the forward section. Being that the bolt for small calibers is shorter in the forward area, the barrels for small calibers are proportionately longer and reach into the receiver to match the shorter bolt assembly. In designing such an arrangement, the rifle is able to function in both magnum calibers and small calibers interchangeably. This provides a receiver that can be reconfigured easily to shoot either magnum- or small-caliber cartridges. The semi-automatic rifle kit disclosed herein enables the user to rapidly reconfigure his or her own rifle for the purpose of utilizing different calibers. The unique feature that facilitates changing the caliber is the relationship between the receiver, bolt assembly, and barrel shank.

As stated previously, the receiver was designed to be large enough to accommodate magnum calibers. In doing so, the bolt assembly must have sufficient travel to move far enough to the rear to allow extraction and ejection of the longer magnum calibers. This amount of travel (e.g., a 2.028-inch stroke) also allows for the feeding from the magazine of live cartridges. The face of the bolt assembly must contact the rear of the barrel shank when in the closed position. Being that the bolt assembly for the magnum caliber must be of sufficient length for this to occur, the length of the barrel shank is proportionate to this. The function of the receiver is to contain these components and maintain their mechanical relationship. The relationship of the bolt assembly and the receiver is critical in this regard. Both a magnum-caliber bolt assembly and a small-caliber bolt assembly must align within the receiver in such a way so as to present the firing pin to the hammer in the same fashion. This must occur even though the magnum-caliber bolt assembly and the small-caliber bolt assembly are of different lengths. The receiver remains unchanged.

In accordance with the disclosed embodiments, the bolt assemblies and barrels were designed in such a way as to mimic one another within the same receiver even though they are of different lengths. The bolt assembly for the magnum calibers is the longer of the two. The barrel shank for magnum calibers is of proportionate length and protrusion into the receiver to form the proper three-component relationship (bolt assembly, barrel shank and receiver). When the rifle is reconfigured for the small calibers, the bolt assembly is proportionately shorter by approximately 0.273 inch. In order to maintain the same three-component relationship, the barrel shank is proportionately longer by 0.273 inch. In accordance with this design, different length bolt assemblies and barrel shanks have the same three-component relationship. This unique design feature gives the rifle the ability to interchange calibers. Another unique design feature is the ease in which the bolt assemblies can be removed and reinstalled.

As stated previously, in other known semi-automatic rifles various components (e.g., the ejector pin and the hammer) stand in the way of instant removal of the bolt assembly. These components protrude up into the path of the bolt assembly. In designs of this nature, the bolt assembly is the first component installed in the receiver during assembly. Subsequent components are then installed. This arrangement effectively prevents the bolt assembly from being rapidly removed or reinstalled, due to the fact that other components must first be removed in order to allow the bolt assembly to be removed. This arrangement does not allow the user to reconfigure their own rifle. A solution to this problem was achieved by designing the bolt with machined relief that cuts lengthwise through the body of the bolt assembly, thus allowing the bolt assembly to override the components that would in other designs prevent the removal of the bolt assembly. This unique design feature allows the bolt assembly to function in its normal mode, but to be rapidly removed and replaced.

FIG. 1 shows a side view of various components (in correct positional relationship but with the receiver removed) of a semi-automatic rimfire rifle configured to shoot magnum-caliber ammunition. The depicted components include the following: a trigger 2 pivotably mounted on a trigger pivot pin 4 supported by the receiver; a hammer 6 pivotably mounted on a hammer pivot pin 8 supported by the receiver; a bolt 10 that is movable backward and forward inside the receiver and is guided by a pair of guide rods 14 (only one of which is visible in FIG. 1) during its travel; a firing pin 12 that is slidable inside a channel formed in the bolt 10; and a barrel 24 that is attached to the receiver by means of a barrel flange 26 and a barrel nut (not shown). Item 28 in FIG. 1 is a pin for properly aligning the barrel relative to the receiver.

The barrel 24 has a barrel shank 20 in which a chamber 22 is formed. The barrel shank 20 is the rearmost portion of the barrel that is inserted inside the receiver. The chamber 22 accepts a magnum-caliber cartridge (not shown). The bolt 10 functions to feed a cartridge into the chamber 22, surround the rim of the cartridge that protrudes outside of the chamber, and facilitate firing. FIG. 1 shows the bolt 10 in its forward position, with its front face abutting the rear face of the barrel shank 20. The front end of the firing pin 12 is separated from the rear face of the barrel shank 20 by a distance equal to or slightly greater than the height of the cartridge rim, which is present between the barrel shank and firing pin when a cartridge is seated inside the chamber 22.

The trigger assembly comprises the trigger 2 and a disconnector hook 18. The disconnector hook 18 and the trigger 2 are separate components that are coupled together, one being movable relative to the other. The disconnector is coupled to the trigger 2 by means of a pin (not shown in FIG. 1). The hammer 6 comprises a first sear release edge or notch 16 and a second sear release edge or notch 28.

When the rifle is cocked and ready to fire (the state shown in FIG. 1), the disconnector hook 18 captures the hammer 6 by means of sear release edge 16 and the sear release edge 28 is engaged by the sear 26 at the trigger nose. When the trigger 2 is pulled, the hammer 6 is released by the sear 26 and the hammer spring (not shown) causes the hammer to move forward (via rotation) and impact the rear end of the firing pin 12. FIG. 1 shows the hammer 6 after its release, but before it strikes the firing pin. The forward moving hammer drives the front end of the firing pin against the rim of the cartridge seated in the chamber 22. This impact on the rim of the cartridge causes the primer inside the casing to explode, thereby igniting the powder charge and propelling the bullet out the barrel 24. The rifle discharges one shot for each depression of the trigger.

Figure 7:
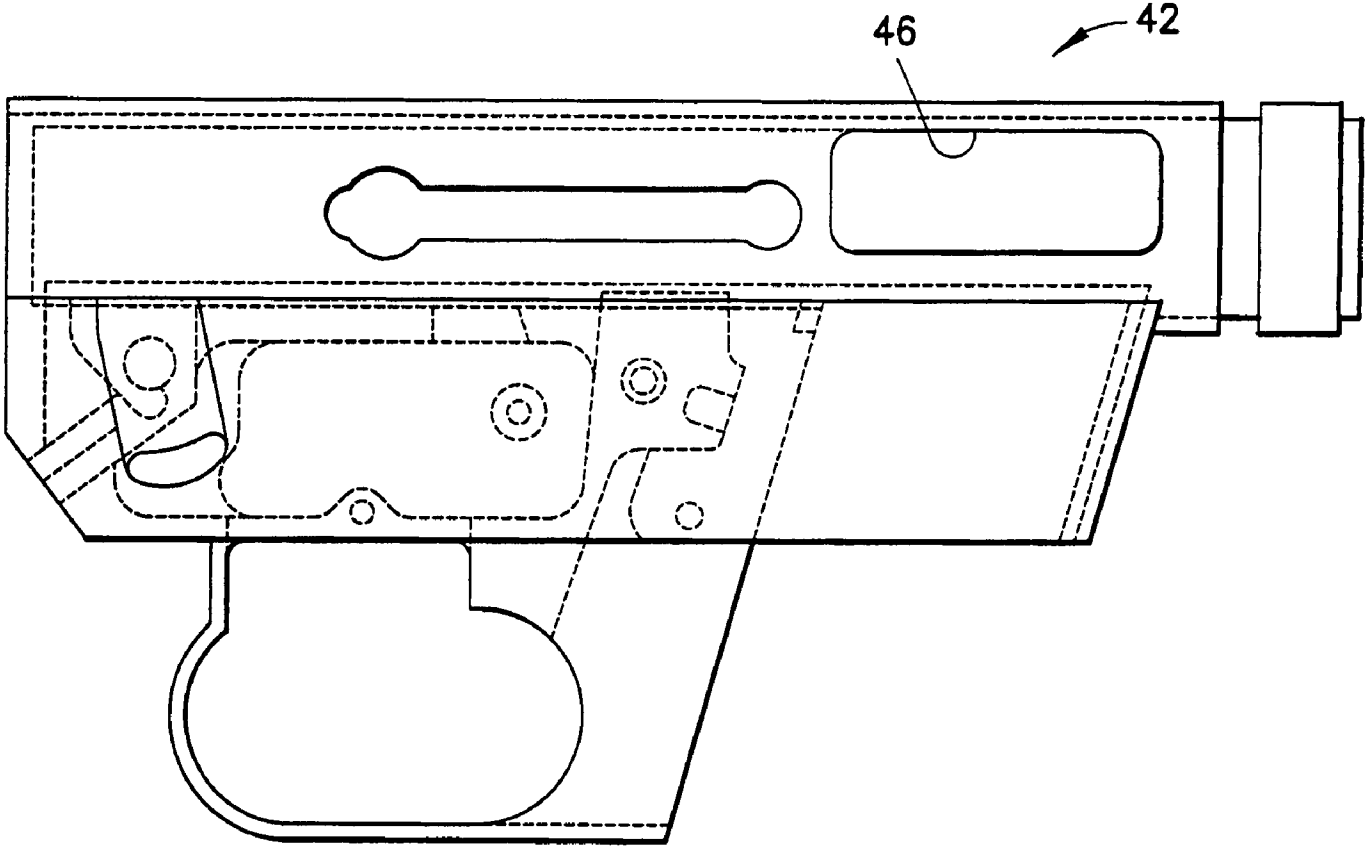
FIG. 7 is a drawing showing a side view of a receiver that remains unchanged for all rifle configurations of the disclosed embodiment.

The reaction force of the explosion inside the cartridge drives the casing (not shown) and the bolt 10 backward. As a result of this bolt recoil, the empty casing is automatically extracted and ejected. A pair of extractors (not shown in FIG. 1) are pivotably coupled to the bolt 10, each extractor comprising an arm with a detent at the end for latching the rim of the cartridge, thereby pulling the empty casing out of the chamber 22 as the bolt is driven backward. In addition, an ejector pin 32 (mounted to the receiver) extends into a second channel in bolt 10 that provides ejector pin clearance. Near the end of the rearward stroke of the bolt 10, the extracted cartridge casing strikes the stationary ejector pin 32 and is ejected out a side opening 46 in the receiver (see FIG. 7). After casing ejection and while the bolt is retracted, a live cartridge from a magnum-caliber magazine 44 (shown in FIG. 2) is pushed in front of the retracted bolt by a spring (not shown) inside of the magazine. The magazine 44 is inserted inside the receiver (not shown in FIG. 2, but see FIG. 7) and held in place by a magazine catch 30 that is pivotably mounted to the receiver. Each guide rod 14 has a coil spring (not shown in the drawings) around it force urging the bolt forward when the recoil energy has been spent. This forward motion of the bolt (by which the front face of the bolt is returned to a position abutting the rear face of the barrel shank) pushes the live cartridge into the chamber 22, so that the rifle is now ready to be fired again.

Figure 2:
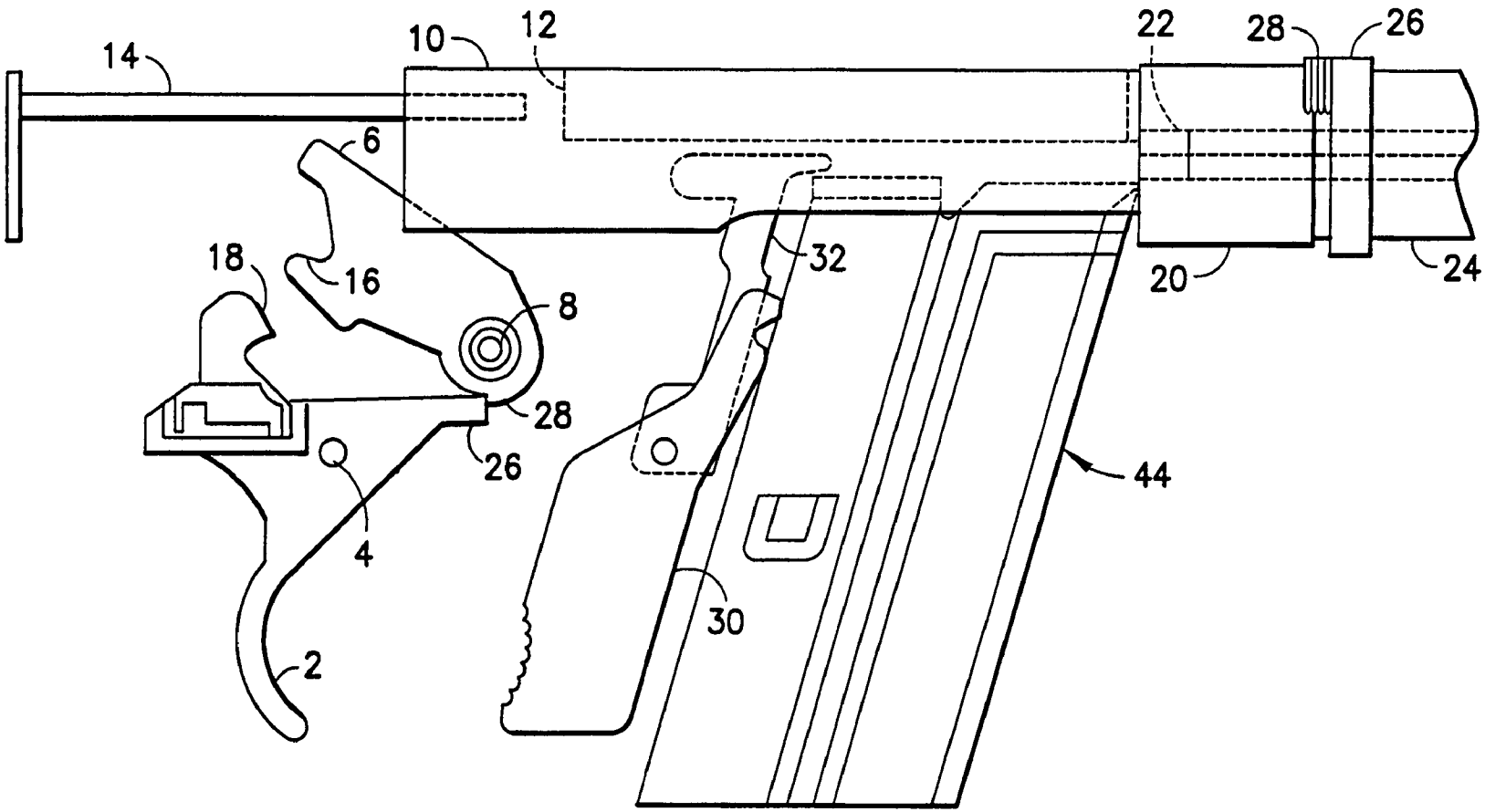
FIG. 2 is a drawing showing a side view of the same components as those shown in FIG. 1, with a magnum-caliber magazine added. Again the receiver is not shown.

As previously mentioned, the bolt assembly and magazine shown in FIG. 2 are designed for use with magnum-caliber cartridges, such as .22 wmrf and .17 hrm calibers. In accordance with one embodiment of the invention, the rifle kit comprises a first barrel dedicated for use with .22 wmrf cartridges and a second barrel dedicated for use with .17 hrm cartridges. Depending on which type of magnum-caliber cartridge the rifle user wishes to shoot, the respective barrel must be coupled to the receiver. The same bolt assembly and same magazine are used for both magnum calibers and need not be changed when the first barrel is replaced by the second barrel or vice versa. The barrel 24 shown in FIGS. 1 and 2 is intended to represent either of the first and second barrels.

Figure 3:
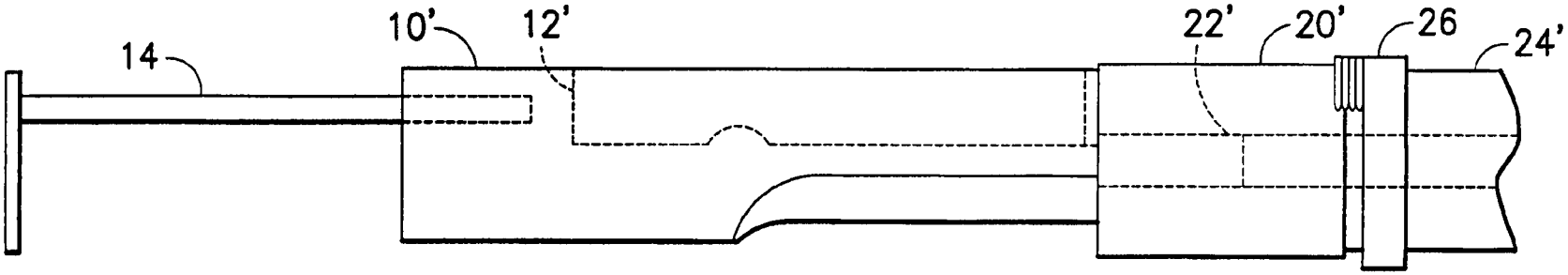
FIG. 3 is a drawing showing a side view of the bolt assembly and the barrel (in correct positional relationship) of a semi-automatic rimfire rifle configured to shoot small-caliber ammunition. The trigger assembly, receiver and a small-caliber magazine are not shown.

In order to change from the magnum calibers to the small calibers, one must change the bolt assembly and magazine along with the barrel. FIG. 3 shows a side view of various components (in correct positional relationship but with the receiver removed) of a semi-automatic rimfire rifle configured to shoot small-caliber ammunition. Like the components shown in FIG. 1, the components shown in FIG. 3 are installed in or coupled to the receiver shown in FIG. 7. The guide rods 14 shown in FIG. 3 are the same as those shown in FIG. 1. Although not shown in FIG. 3, the trigger assembly, hammer, ejector pin and magazine catch inside the receiver will not be changed when the rifle is reconfigured from magnum caliber to small caliber. The only components that will be different are the bolt assembly, the barrel and the magazine. The bolt assembly comprises a bolt 10' that is shorter than the bolt 10 shown in FIG. 1, and a firing pin 12' that is shorter than the firing pin 12 shown in FIG. 1. The barrel 24' has barrel shank 20' that is longer than the barrel shank 20 shown in FIG. 1. However, the aforementioned three-component relationship is maintained amongst the bolt, barrel shank and receiver such that the rear ends of both firing pins 12 (in FIG. 1) and 12' (in FIG. 3) are in the same position relative to the hammer for both rifle configurations. The stroke of bolt 10' for the small-caliber design is 1.938 inch as compared to a bolt stroke of 2.028 inch for the magnum-caliber design.

Figure 4:
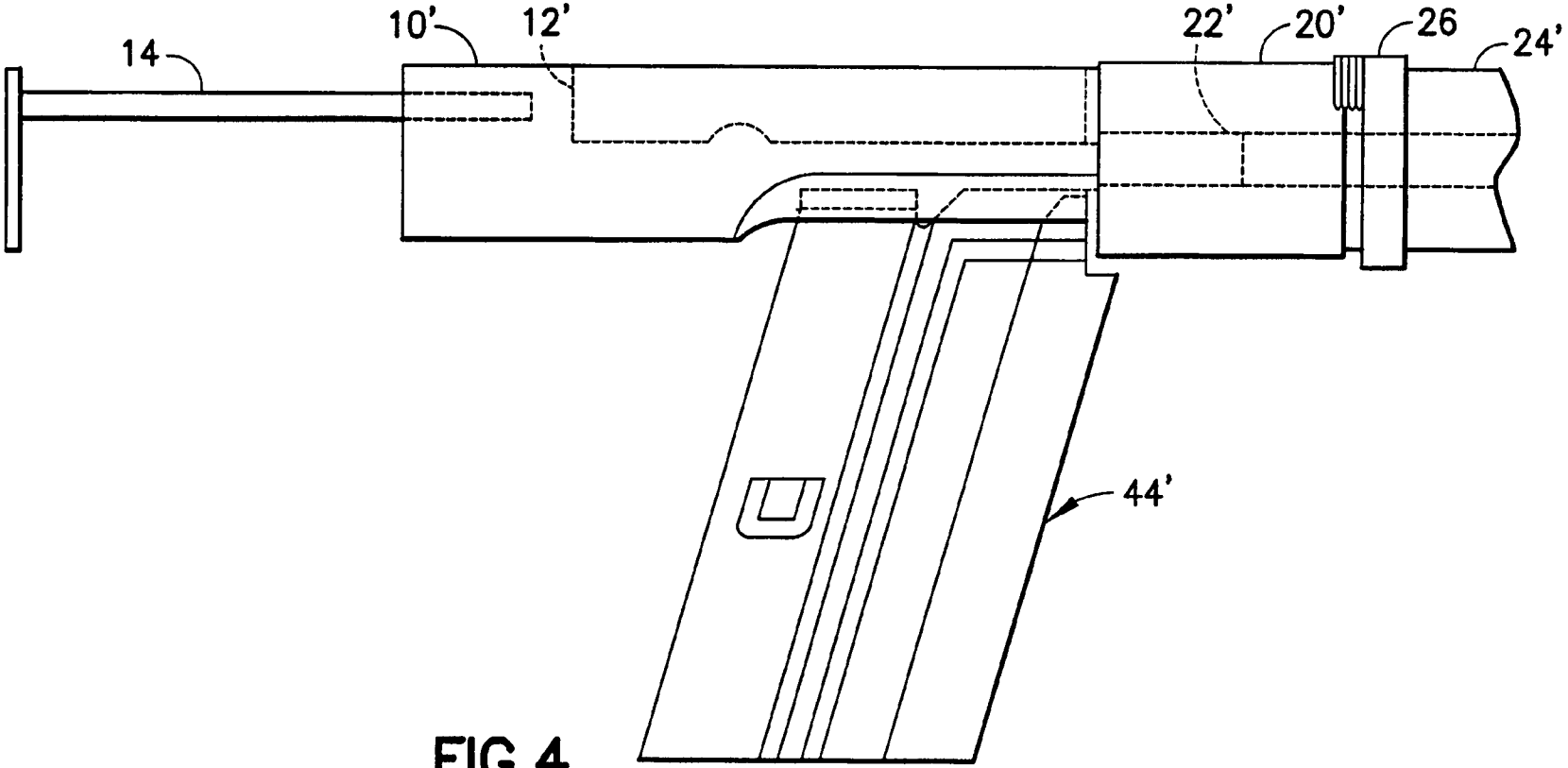
FIG. 4 is a drawing showing a side view of the same components as those shown in FIG. 3, with a small-caliber magazine added. Again the trigger assembly and the receiver are not shown.

FIG. 4 shows the same components as shown in FIG. 3, but with a magazine 44' added. The magazine 44' is designed to contain a plurality of small-caliber cartridges, to fit inside the receiver shown in FIG. 7 and be latched by the magazine catch, and to provide clearance for the longer barrel shank 20' at the top of the magazine.

As previously mentioned, the bolt assembly and magazine shown in FIG. 4 are designed for use with small-caliber cartridges, such as .22 lr and .17 hm2 calibers. In accordance with the embodiment of the invention disclosed herein, the rifle kit further comprises a third barrel dedicated for use with .22 lr cartridges and a fourth barrel dedicated for use with .17 hm2 cartridges. Depending on which type of small-caliber cartridge the rifle user wishes to shoot, the respective barrel must be coupled to the receiver. The same bolt assembly and same magazine are used for both small calibers and need not be changed when the third barrel is replaced by the fourth barrel or vice versa. The barrel 24' shown in FIGS. 3 and 4 is intended to represent either of the third and fourth barrels.

Figure 5:
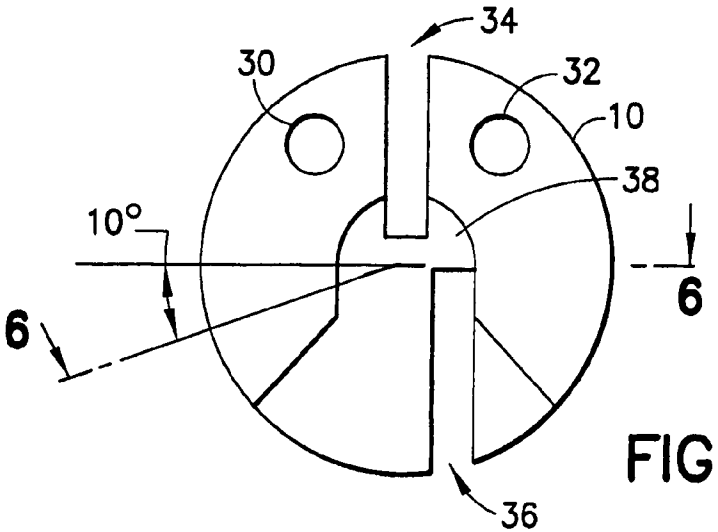
FIG. 5 is a drawing showing a view of the front face of a bolt in accordance with one embodiment of the invention.
Figure 6:
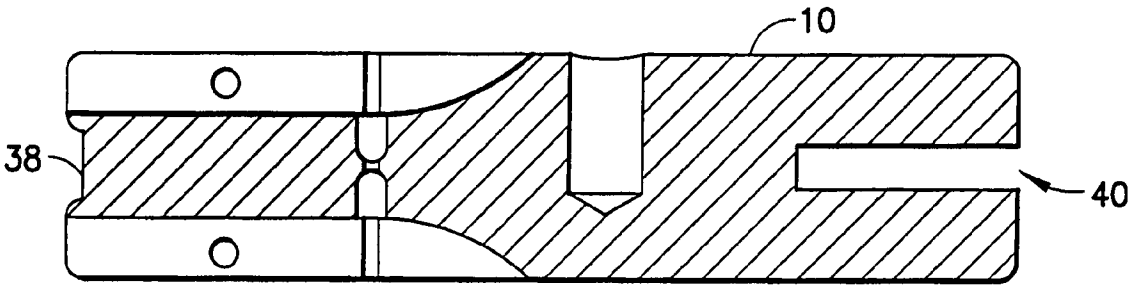
FIG. 6 is a drawing showing a sectional view of the bolt shown in FIG. 5, wherein the section is taken along the line 6-6.

FIG. 5 shows a view of the front face of a bolt in accordance with the disclosed embodiment of the invention. FIG. 6 is a sectional view of the bolt shown in FIG. 5, wherein the section is taken along the line 6-6. While the respective lengths of the bolts employed in the magnum-caliber and small-caliber configurations differ in length, they have the same geometry. Referring to FIG. 5, the bolt is a monolithic machined piece having a pair of mutually parallel circular cylindrical bores 30 and 32, in which the guide rods will be respectively slidably inserted. A longitudinal channel 34 machined in the bolt will accept the firing pin. Another longitudinal channel 36 machined in the bolt provides clearance for the ejector pin during bolt removal (the rear end of the channel 36 is not closed). The front face of the bolt is machined to provide a breech face 38 that provides clearance for the rim of the cartridge when the bolt abuts the barrel shank. A channel 40 (seen in FIG. 6) machined in the rear of the bolt communicates with the channel 34 and provides clearance for the hammer.

While the invention has been described with reference to preferred embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

The invention claimed is:

1. A blowback-operated semi-automatic rifle kit comprising:

a receiver;

first and second bolt assemblies that are interchangeably insertable inside said receiver through an opening at a forward end of said receiver only when no barrel is coupled to said receiver;

first and second barrels that are interchangeably attachable to said forward end of said receiver, said first barrel being attachable when said first bolt assembly is inside said receiver and having a first barrel length, and said second barrel being attachable when said second bolt assembly is inside said receiver and having a second barrel length greater than said first barrel length, wherein said first bolt assembly and said first barrel are for use with a first type of cartridge, but not a second type of cartridge, and said second bolt assembly and said second barrel are for use with said second type of cartridge, but not said first type of cartridge, said first bolt assembly comprising a first bolt that is driven backwards by a reaction force of the explosion inside said first cartridge during firing when said receiver, said first bolt assembly and said first barrel are assembled, and said second bolt assembly comprising a second bolt that is driven backwards by a reaction force of the explosion inside said second cartridge during firing when said receiver, said second bolt assembly and said second barrel are assembled, said first bolt having a first bolt length and said second bolt having a second bolt length less than said first bolt length.

2. The semi-automatic rifle kit as recited in claim 1, further comprising first and second magazines that can be interchangeably inserted inside said receiver, said first magazine being designed to contain a plurality of cartridges of said first type, and said second magazine being designed to contain a plurality of cartridges of said second type.

3. The semi-automatic rifle kit as recited in claim 1, further comprising an ejector pin fixedly supported inside said receiver, wherein said first bolt has a first channel that overrides said ejector pin when said first bolt is being inserted inside said receiver, and said second bolt has a second channel that overrides said ejector pin when said second bolt is being inserted inside said receiver, said first and second bolts having different lengths, and said first and second channels each having a rear end that is not closed.

4. The semi-automatic rifle kit as recited in claim 1, wherein said first bolt has a channel, said first bolt assembly further comprises a first firing pin residing in said channel of said first bolt, said first firing pin having an aft end located at a predetermined position relative to said receiver when said first bolt is inserted in said receiver and a cartridge of said first type is inserted in a chamber of a shank of said first barrel, and said second bolt has a channel, and said second bolt assembly further comprises a second firing pin residing in said channel of said second bolt, said second firing pin having an aft end located at said predetermined position relative to said receiver when said second bolt is inserted in said receiver and a cartridge of said second type is inserted in a chamber of a shank of said second barrel, further comprising a hammer pivotably mounted to said receiver for striking the aft end of whichever one of said first and second firing pins is disposed inside said receiver when a trigger pivotably mounted to said receiver is pulled.

5. The semi-automatic rifle kit as recited in claim 1, further comprising a third barrel that can be coupled to said receiver after said first bolt assembly has been inserted inside said receiver, and a fourth barrel that can be coupled to said receiver after said second bolt assembly has been inserted inside said receiver, wherein said third barrel is structured for use with a third type of cartridge, but not said first and second types of cartridge and not a fourth type of cartridge, said fourth barrel is structured for use with said fourth type of cartridge, but not any of said first through third types of cartridge, said first bolt assembly being also useable with said third type of cartridge, and said second bolt assembly being also useable with said fourth type of cartridge.

6. The semi-automatic rifle kit as recited in claim 1, wherein cartridges of said first type have a magnum caliber and cartridges of said second type have a small caliber.

7. The semi-automatic rifle kit as recited in claim 6, wherein said magnum caliber is either .22 wmrf or .17 hrm and said small caliber is either .221 r or .17 m2.

8. The semi-automatic rifle kit as recited in claim 5, wherein cartridges of said first type have caliber .22 wmrf, cartridges of said second type have caliber .221 r, cartridges of said third type have caliber .17 hrm and cartridges of said fourth type have caliber .17 m2.

* * * * *